US010519653B2

(12) United States Patent
Schulz-Hanke et al.

(10) Patent No.: US 10,519,653 B2
(45) Date of Patent: Dec. 31, 2019

(54) FACADE ASSEMBLY, BUILDING STRUCTURE, AND METHOD FOR MOUNTING THE FACADE ASSEMBLY

(71) Applicant: HILTI AKTIENGESELLSCHAFT, Schaan (LI)

(72) Inventors: Wolfgang Schulz-Hanke, Untermeitingen (DE); Sebastian Simon, Buchloe Lindenberg (DE)

(73) Assignee: HILTI AKTEINGESELLSCHAFT, Schaan (LI)

( * ) Notice: Subject to any disclaimer, the term of this patent is extended or adjusted under 35 U.S.C. 154(b) by 0 days.

(21) Appl. No.: 16/183,098

(22) Filed: Nov. 7, 2018

(65) Prior Publication Data

US 2019/0078327 A1 Mar. 14, 2019

Related U.S. Application Data

(63) Continuation of application No. 15/543,057, filed as application No. PCT/EP2016/052466 on Jul. 12, 2017, now Pat. No. 10,138,629.

(30) Foreign Application Priority Data

Feb. 13, 2015 (EP) ..... 15154948

(51) Int. Cl.
*E04B 1/94* (2006.01)
*E04B 1/76* (2006.01)
(Continued)

(52) U.S. Cl.
CPC ..... *E04B 1/948* (2013.01); *E04B 1/7612* (2013.01); *E04B 1/7625* (2013.01); *E04B 1/94* (2013.01);
(Continued)

(58) Field of Classification Search
None
See application file for complete search history.

(56) References Cited

U.S. PATENT DOCUMENTS 3,786,604 A * 1/1974 Kramer ..... E04B 1/6801 52/232
4,449,341 A * 5/1984 Taglianetti ..... E04B 2/88 52/235
(Continued)

FOREIGN PATENT DOCUMENTS

DE 20 2006 008 125 U1 9/2006
EP 1 731 685 12/2006
(Continued)

OTHER PUBLICATIONS

International Search Report dated Mar. 4, 2016, in PCT/EP2016/052466 filed Feb. 5, 2016.

*Primary Examiner* — Brian E Glessner
*Assistant Examiner* — Adam G Barlow
(74) *Attorney, Agent, or Firm* — Grüneberg and Myers PLLC

(57) ABSTRACT

A facade assembly for a building can have at least one facade element, which may be fastened to a wall or an inter-story ceiling of the building. The assembly can also have at least one fire-protection element, which may be mounted between the facade element and the wall or the inter-story ceiling. The fire-protection element contains an insulating layer and at least one angle profile with two flanges disposed at an angle relative to one another, wherein one of the flanges of the angle profile is fastened to the facade element and the other flange of the angle profile bears on the insulating layer.

20 Claims, 2 Drawing Sheets

Figure 1:
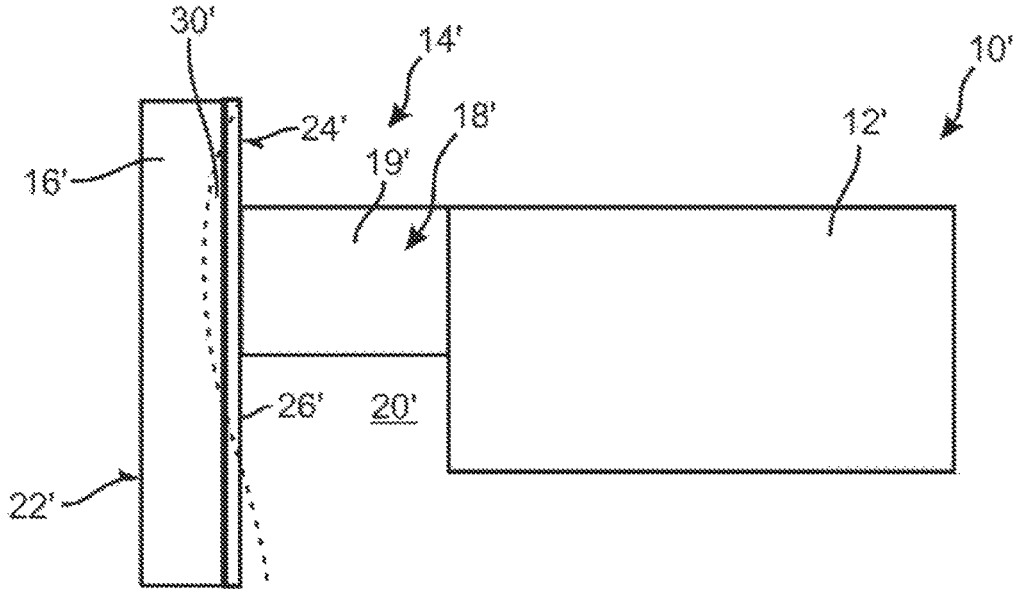

(51) Int. Cl.
*E04B 2/74* (2006.01)
*E04B 2/88* (2006.01)
*E04B 2/96* (2006.01)

(52) U.S. Cl.
CPC ..... *E04B 1/947* (2013.01); *E04B 2/7411* (2013.01); *E04B 2/88* (2013.01); *E04B 2/962* (2013.01); *E04F 2290/046* (2013.01)

(56) References Cited

U.S. PATENT DOCUMENTS 5,502,937 A * 4/1996 Wilson ..... B32B 15/14 52/273
7,424,793 B1 * 9/2008 Shriver ..... E04B 2/88 52/235
7,644,549 B2 * 1/2010 Speck ..... E04B 2/90 52/235
7,856,775 B2 12/2010 Stahl, Jr.
8,595,999 B1 * 12/2013 Pilz ..... E04B 1/943 52/232
8,671,645 B1 * 3/2014 Shriver ..... E04B 2/88 156/71
8,782,977 B2 * 7/2014 Burgess ..... E04B 2/00 52/235
9,752,318 B2 * 9/2017 Pilz ..... E04F 13/00
9,869,086 B2 * 1/2018 Andresen ..... E04B 1/68
2007/0204540 A1 * 9/2007 Stahl, Sr. ..... E04B 1/94 52/274
2009/0126297 A1 * 5/2009 Stahl, Jr. ..... E04B 2/88 52/235
2010/0107532 A1 * 5/2010 Shriver ..... E04B 2/96 52/317
2014/0137494 A1 * 5/2014 Stahl, Jr. ..... E04B 1/941 52/235
2016/0208484 A1 * 7/2016 Pilz ..... E04F 13/00
2016/0356034 A1 * 12/2016 Andresen ..... E04B 1/68
2017/0260741 A1 * 9/2017 Ackerman ..... E04B 1/947
2017/0370097 A1 * 12/2017 Schulz-Hanke ..... E04F 13/14
2018/0002922 A1 * 1/2018 Schulz-Hanke ..... E04B 1/7612

FOREIGN PATENT DOCUMENTS

JP 6-229038 8/1994
JP 2010-1646 1/2010
JP 2011-190613 9/2011
JP 2011-196093 A 10/2011
KR 10-2011-0113841 10/2011

* cited by examiner

FACADE ASSEMBLY, BUILDING STRUCTURE, AND METHOD FOR MOUNTING THE FACADE ASSEMBLY

This application is a continuation of U.S. application Ser. No. 15/543,057, filed on Jul. 12, 2017, which was the National Stage entry under § 371 of International Application No. PCT/EP2016/052466, filed on Feb. 5, 2016, and which claims the benefit of European Application No. 15154948.2, filed on Feb. 13, 2015, all of which are incorporated in their entireties by reference.

The invention relates to a facade assembly for a building with at least one facade element, which can be fastened to a wall or a ceiling of the building, and with at least one fire-protection element, which can be mounted between the facade element and the wall. The invention further relates to a building structure using the facade assembly and to a method for mounting such a facade assembly.

Curtain facades comprising individual facade elements, which are fastened to a shell of a building, are frequently used in the building sector. The shell may be manufactured in skeleton form and the facade elements constitute the exterior skin of the building, in which case the facade elements take over the function of a wall construction. The individual facade elements usually have a substructure, for example a framework, by means of which the facade elements are fastened to the shell. These facade elements bear only their own weight and for the most part have no static functions. However, the facade elements may take over insulating functions as well as stylistic functions for the exterior skin.

On the back side, the facade elements have not only the windows/glass elements, but frequently also a cladding, which consists of metal such as steel sheet, for example. Joints sealed by insulating material, comprising mineral wool in the prior art, are present between the shell and the facade elements, in order to prevent propagation of fire behind the facade elements in the event of fire. These insulating elements are disposed at the height of the inter-story ceilings, so that spreading of the fire from one story to another story is prevented. In which case the fire-protection elements are also able to take over further insulating functions, such as sound protection, for example.

Especially for facade elements with a metal cladding on the back side, large deformations of the cladding and thus of the facade elements may occur in the event of fire. These deformations may cause the joint between the wall or the ceiling and the facade element to grow larger, and so the insulating element of compressed mineral wool is no longer able to fill the joint between the facade element and the wall or the ceiling completely and seal it against fire or smoke.

In addition, the enlargement of the joint may cause the insulating element to lose its connection to the facade element and the wall or ceiling partly or completely and, because of its own weight, to increase the size of the joint further by tilting or falling down. Thereby penetration of fire or smoke into the story located above is further favored.

In the prior art, it has previously been the practice, in order to compensate for a joint that becomes larger in the event of fire, to close the joint between the facade element and the inter-story ceiling or wall with compressed mineral wool and to apply a coating, whereby fire or smoke is supposed to be prevented from penetrating into the story located above. For this purpose, the installed mineral wool is in particular compressed, in order to compensate for the joint changes. In this case the facade elements may be additionally reinforced by introduction of profiles, such as a channel profile, for example, on the side or the cladding facing away from the shell. Thus the channel profile is not provided between the facade element ad the wall or ceiling, but instead is positioned inside the facade element. This mechanical reinforcement is intended to prevent deformation of the facade element in the event of fire.

From U.S. Pat. No. 7,856,775 B2, it is known to fix an additional mineral-wool block on the cladding underneath the insulating element filling the joint. The additional mineral-wool block is intended to close the gap that develops in the event of fire.

Nevertheless, considerable work effort is necessary for mounting the prior-art fire-protection elements. The attachment of the additional mineral-wool block and/or of the channel section additionally necessitates tasks at ladder height in the story underneath the insulating element and thus leads to a higher risk of injury as well as additional time requirements.

The object of the invention is to provide a facade assembly that permits better sealing of the joint between facade element and wall or ceiling in the event of fire and thus provides better fire protection.

The object is solved by providing a facade assembly for a building, with at least one facade element, which may be fastened to a wall or a ceiling of a building, and with at least one fire-protection element, which comprises an insulating layer and at least one angle profile with two flanges disposed at an angle relative to one another, wherein one of the flanges of the angle profile is fastened to the facade element and the other flange of the angle profile bears on the insulating layer.

The angle profile is preferably molded from a material with sufficient stiffness and thickness that the profile is at least self-supporting. These materials are generally known to the person skilled in the art.

Preferably the angle profile comprises or consists of one or more materials selected from metal, preferably iron or steel, intumescent fire-protection materials, non-intumescent fire-protection materials and combinations thereof. In particular, the fire-protection materials may be fiber reinforced, especially glass-fiber-reinforced.

Intumescent fire-protection materials may comprise a chemically or physically intumescent material and in particular may contain an acid-forming agent, such as ammonium polyphosphate, a propellant such as melamine or melamine derivatives and an ash-forming material such as polyhydroxy compounds and/or expanded graphite. The intumescent fire-protection materials may be optionally fiber-reinforced, especially glass-fiber-reinforced. The invention is not limited to the use of particular intumescent materials. All materials known to the person skilled in the art may be used.

Examples of non-intumescent fire-protection materials are low-flammability or non-flammable building materials such as mineral-fiber beards and gypsum boards as well as lightweight excelsior panels and hard-foam boards with flame-retardant additive.

The angle profile is fixed in such a way to the rear metal cladding of the facade element at the height of the insulating layer that the flange of the angle profile directed substantially transversely relative to the facade element covers the gap between insulating layer and facade element that may have developed due to enlargement of the joint in the fire situation. Typically, the flange running in transverse direction and the insulating layer are brought into contact with one another. The flange of the angle profile running along the facade element and fastened there to the cladding achieves additional stiffening of the facade element and thus reduces or prevents distortion of the metal cladding and thus enlargement of the joint and development of a gap, which may favor the penetration of smoke or tire.

The fire-protection element, together with insulating layer and angle profile, can be advantageously installed from a single story level and particularly advantageously at the floor level of the story in which the joint to be sealed between facade element and inter-story ceiling runs. Thereby there is no need for work at ladder height, which means not only increased time requirements but also the risk of injury for the installers.

According to a preferred embodiment the angle profile is an L-shaped profile, which may have equal or unequal legs. Depending on installation situation, however, the angle profile may also be formed as a special profile, wherein the angle included by the two flanges may lie in the range of approximately 80° to 100°.

The alignment and position of the angle profile or L-shaped profile may be selected in such a way that both flanges or legs of the angle profile are disposed outside the insulating layer. In this embodiment, therefore, the flange fastened to the facade element points away from the insulating layer. The flange running in transverse direction relative to the facade element bears on the insulating layer and in this embodiment is disposed above or in front of the insulating layer. After introduction of the insulating layer info the joint, the angle profile may be mounted from the same story level or the same room, especially at the floor side on the respective story level from which the insulating layer was also introduced into the joint. Thereby not only the risk of injury but also the time required for mounting the fire-protection element can be reduced.

According to a further embodiment, the alignment and position of the angle profile may be selected in such a way that the flange of the angle profile running along the facade element and fastened there is disposed between the insulating layer and the facade element. During mounting of the fire-protection element in the joint between inter-story ceiling and facade element, the flange of the angle profile running transversely relative to the facade element is then preferably disposed behind or underneath the insulating layer. Thereby dropping down or falling over of the insulating layer during enlargement of the joint due to distortion of the iron sheet may be additionally prevented. In this embodiment also, the insulating layer and of the angle profile may be mounted from the same story level or the same room, in which case the angle profile is first fastened inside the joint to the facade element and then the insulating layer is introduced into the joint. The two embodiments may be combined with one another, meaning that two angle profiles may be provided, wherein the angle profile that is lower, for example, during mounting in the joint between inter-story ceiling and facade element has a flange disposed between insulating layer and facade element, and the opposite, upper angle profile has a flange directed away from the insulating layer.

Preferably at least one of the flanges of the angle profile comprises or consists of an intumescent material. Particularly preferably, both flanges of the angle profile comprise or consist of the intumescent material. The intumescent material foams up under the effect of heat, and so it is able to fill a gap that, in the event of fire, develops or is already present between facade element and wall or ceiling. Thereby additional protection is provided against propagation of fire or smoke.

Since the intumescent material has very low volume in the non-activated condition, it may also be applied in the form of a coating on at least one of the flanges, preferably both flanges, of the angle profile, which flanges may be formed inexpensively from iron or steel in this case. In this embodiment of the invention, not only can the facade element be stabilized effectively against distortion and the joint that becomes larger in the fire situation be covered by the further flange. To the contrary, additional sealing is achieved by the formed intumescent foam.

Preferably at least the flange of the angle profile running transversely relative to the facade element comprises an intumescent material, especially on its side facing the insulating layer. Furthermore, it is advantageous, in the embodiments of the present invention in which the flange running along the facade element and fastened there is disposed between the facade element and the insulating layer, to mold both legs of the angle profile from an intumescent material or to coat both legs on their sides directed toward the insulating material with an intumescent material. In this way, the material foaming up during the action of heat is able to further improve the sealing of the gap that develops between the facade element and the sealing element in the event of fire.

The facade element is known in principle from the prior art. Preferably the facade element is designed as a curtain facade, with a frame construction, preferably of steel or aluminum, and an outer covering, which is joined to the frame construction and can be formed from glass, ceramic, metal or natural stone. Cladding, preferably formed from metal or steel sheet, is provided on the back side of the covering, which in the installed condition faces the building. A deadening or insulating layer, for example of mineral wool or foam, may be provided between the exterior covering and the cladding.

According to the invention, the fire-protection element has an insulating layer, preferably a mineral-wool insulating layer, particularly preferably a compressed mineral-wool insulating layer. In the regular installation condition, the insulating layer establishes sealing of the joint between facade element and inter-story ceiling or wall. In addition, the insulating layer is able to compensate for small distortions of the facade element in the fire situation and prevent or reduce penetration of smoke or fire, so that basic protection against propagation of fire and smoke is provided. The insulating layer is preferably designed such that the fire-protection element fills and seals the joint in the regular installation condition.

The angle profile is fastened on the facade element, in which case any desired chemical or mechanical types of fastening are possible, for example adhesive bonding or fastening with additional fixation elements such as rivets or screws.

According to the invention, it is sufficient for at least one angle profile or L-shaped profile to be present. However, to permit better stability against distortion of the facade element and better sealing of the joint in the event of fire, while at the same time preventing the insulating layer from falling down, two angle profiles may also be provided, wherein one is provided above and one underneath the insulating layer and brought into contact therewith.

If the angle profile or L-shaped profile consists completely or partly of an intumescent material, a protective layer that covers the fire-protection element at least partly may be optionally provided, in order to prevent damage to the fire-protection element during mounting or during construction of the building. As an example, this protective layer may consist of an elastic material such as a curable acrylic dispersion, which is able to even out the temperature-induced expansions of the building or of the facade assembly.

Further subject matter of the invention is a building structure, with at least one wall and/or one inter-story ceiling and at least one facade element, which is fastened to a wall or an inter-story ceiling, wherein a joint is formed between the facade element and the wall or the inter-story ceiling, and with at least one fire-protection element, which is mounted in the region of the joint between the facade element and the wall or the inter-story ceiling, wherein the fire-protection element comprises an insulating layer and at least one angle profile with two flanges disposed at an angle relative to one another, wherein one of the flanges of the angle profile is fastened to the facade element and the other flange of the angle profile bears on the insulating layer.

The facade element and the fire-protection element form the above-described facade assembly to which reference is made.

According to one embodiment, the flange of the angle profile fastened on the facade element points away from the joint or the insulating layer, and the other flange, which runs transversely relative to the facade element, is disposed on the front side of the insulating layer positioned opposite the joint.

According to a further embodiment, the flange of the angle profile fastened on the facade element points into the joint and is disposed between the insulating layer and the facade element. The other flange, which runs transversely relative to the facade element, is disposed on the bottom side of the insulating layer positioned opposite the joint.

Both embodiments permit mounting of the insulating layer and of the angle profile from the same slop/level or the same room.

The object is further solved by a method for mounting a facade assembly for a building, with at least one facade element, which is fastened to a wall or a ceiling of the building, and with at least one fire-protection element, which is mounted between the facade element and the wall or the ceiling, wherein the fire-protection element comprises at least one insulating layer and at least one angle profile, with the following steps:

- attachment of the facade element to the wall or the inter-story ceiling of the building, wherein a joint is formed between the facade element and the wall or the inter-story ceiling,
- attachment of the fire-protection element to the facade element and/or to the wall or the inter-story ceiling of the building in the region of the joint, wherein one flange of the angle profile is fastened to the facade element and the other flange of the angle profile is brought into contact with the insulating layer.

Preferably the insulating layer is compressed, so that it is able to expand upon a slight deformation of the facade element and at least partly close the resulting joint.

According to one embodiment of the inventive method, the insulating layer first introduced into the joint and then the angle profile is applied on the front side of the insulating layer positioned opposite the joint.

According to a further embodiment the angle profile is first mounted in the joint, wherein the flange of the angle profile that runs along the facade element points into the joint and is fastened there to the facade element. Then the insulating layer is introduced into the joint and laid on the flange running transversely relative to the facade element of the angle profile.

In addition, the insulating layer may be fastened to the wall or inter-story ceiling of the building.

In order to protect the tire-protection element and additionally to seal it against propagation of smoke, a protective layer, especially of an elastic material, is preferably applied, wherein the protective layer covers the fire-protection element at least partly, preferably completely.

Figure 2:
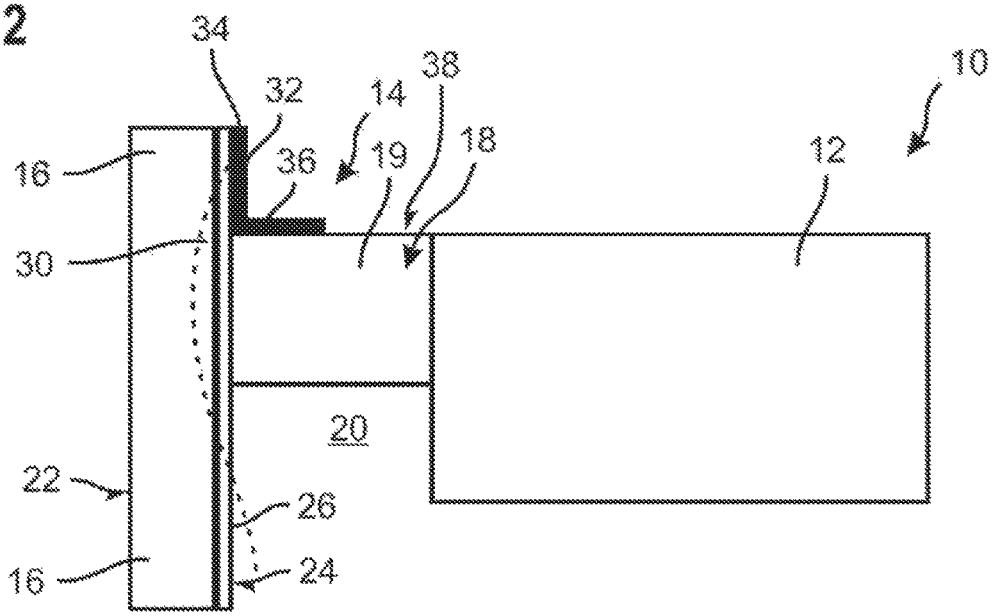
Prior art Fig. 2
Figure 3:
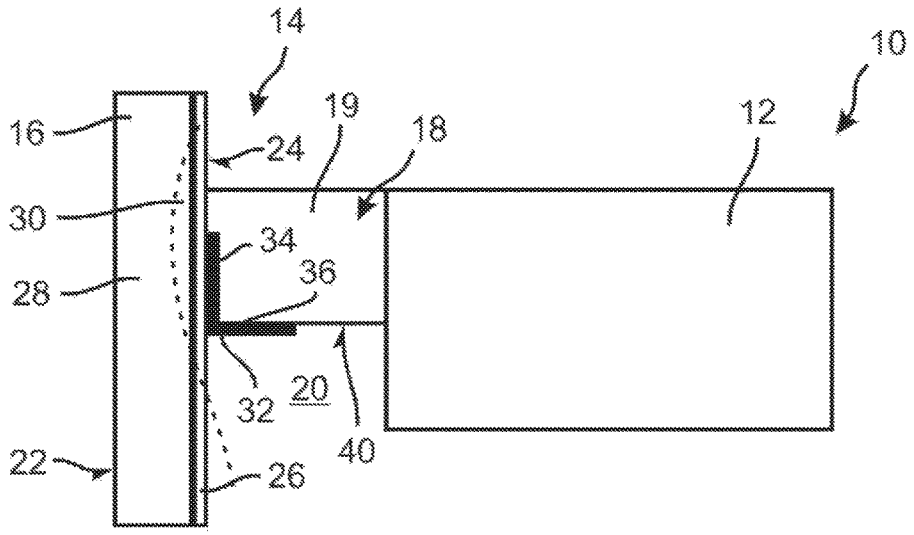

Further advantages and features will become obvious from the description hereinafter in conjunction with the attached drawings, wherein:

FIG. 1 shows a sectional view through a building with a facade assembly according to the prior art, FIG. 2 shows a sectional view through a building with a first embodiment of an inventive facade assembly, and FIG. 3 shows a sectional view through a building with a second embodiment of an inventive facade assembly.

FIG. 1 shows a section of a building 10' with an inter-story ceiling 12'. A facade assembly 14' is hung in curtain style on the exterior of building 10'.

Facade assembly 14' consists of a facade element 16' as well as a fire-protection element 18', which is disposed in a joint 20' between inter-story ceiling 12' and facade element 18'. Fire-protection element 18' consists here of an insulating layer 19', for example of mineral wool.

Facade element 16' forms an exterior wall construction or the facade of building 10' and has a substructure, not illustrated in detail here, for example a framework, on which the individual elements of the exterior facade, for example wall elements, windows as well as insulating layers, are retained. The substructure serves for fastening of facade elements 16' on building 10'.

Facade assembly 14' serves stylistic purposes and/or protection of building 10', wherein exterior side 22' of such a facade element 16' can be configured in any desired manner, especially as a function of viewpoints related to style and/or building physics. As an example, exterior side 22' may have elements of glass, ceramic, metal or other suitable materials.

Facade assembly 14' or facade elements 16' bear only their own weight and have no static function for building 10'.

On back side 24' facing building 10', cladding is provided, which may be part of the interior wall of building 10' and consists here of steel sheet 26'. This steel sheet 26' may be part of the substructure or may form merely the interior closure of the facade element.

By virtue of fire-protection element 18' provided between inter-story ceiling 12' and facade element 16' penetration of smoke and fire from a region below inter-story ceiling 12' into the region above inter-story ceiling 12' in the event of fire is prevented, and so the propagation of a fire can be prevented or at least slowed.

Due to the high temperatures occurring during a fire, however, deformation of facade element 16', especially of steel sheet 26' may occur (see dashed line in FIG. 1). This deformation may cause a gap 30', through which penetration of smoke or fire is possible, to develop between fire-protection element 18' and facade element 16'. This means that fire-protection element 18' is not able to fulfill its fire-protection function completely if facade element 16' becomes badly deformed.

In order to eliminate this disadvantage, facade assembly 14 shown in FIG. 2 is provided. The basic design of building 10 with an inter-story ceiling 12 as well as curtain-type facade element 16 corresponds substantially to the design shown in FIG. 1.

Besides insulating layer 19, however, fire-protection element 18 additionally has a rigid angle profile 32, which is formed as an L-shaped profile in the embodiment shown here. The L-shaped profile may have equal or unequal legs. In the embodiment shown here, both flanges 34, 36 of angle profile 32 are disposed outside insulating layer 19 and facade element 16, wherein vertical flange 34 running along the facade element is directly fastened to steel sheet 26 of facade element 16.

Horizontal flange 38 running transversely relative to facade element 18 bears directly on insulating layer 19. Gap 30, which is formed between insulating layer 19 and facade element 16 due to deformation of facade element 16 in the event of fire, remains closed by horizontal flange 36 of angle profile 32 positioned above it, so that reliable fire protection continues to be ensured.

In the embodiment shown here, insulating layer 13 is fastened at least to inter-story ceiling 12, while angle profile 32 is fastened on facade element 16, in which case the fastening may be achieved respectively by a frictional, interlocking and/or substance-to-substance joint, for example by mechanical or chemical types of fastening.

Vertical leg or flange 34 of L-shaped profile 32 is disposed at floor height of the story located above and is positioned or front side 38 of insulating layer 19 opposite joint 20. This permits safe and simple fastening of the profile on the facade element. As soon as facade element 16 deformed because of intense heat during a fire, gap 30 is formed.

Horizontal flange 36 of angle profile 32, which is disposed above this gap 30 by the positioning on facade element 16, reliably seals gap 30.

For mounting of fire-protection element 18, insulating layer 19 is first introduced into joint 20 and if necessary is fastened to inter-story ceiling 12 or wall. Angle profile 32 is applied on the front side 38 of insulating layer 19 positioned opposite joint 20, so that a flange 36 of the angle profile running transversely relative to facade element 16 rests directly on insulating layer 19. Angle profile 32 is fastened on the facade element with the other flange 34, which runs along facade element 16 and is directed away from insulating layer 19. In this way insulating layer 19 and angle profile 32 may be mounted from the same story level or the same room in simple and time-saving manner.

In the embodiment shown in FIG. 3, horizontal leg or flange 36 of angle profile 32 running transversely relative to facade element 16 is disposed on bottom side 40 of insulating layer 19, which is opposite joint 20. Vertical leg or flange 34, which is fastened on facade element 16, is disposed between insulating layer 19 and facade element 16.

In this embodiment also, a gap 30 developed in the event of fire is reliably sealed by horizontal flange 36 of angle profile 32 running transversely relative to the facade element. In addition, dropping down or falling over of insulating layer 19 during enlargement of joint 20 that occurs due to distortion of steel sheet 26 may be prevented.

In this embodiment, for mounting of fire-protection element 18, angle profile 32 is first mounted in joint 20, wherein vertical flange 34 of angle profile 32 running along facade element 16 points into joint 20 and is fastened there to facade element 16. Then insulating layer 19 is introduced into joint 20 from the same story level and laid on horizontal flange 36 of angle profile 32 running transversely relative to facade element 16.

In all embodiments, angle profile 32 may be formed completely or partly from an intumescent material. In particular, it is advantageous to coat the leg of the angle profile running transversely relative to facade element 16 with the intumescent material, for example on its side facing insulating layer 19. Foaming up of the intumescent material during the effect of heat may then lead to improved sealing of gap 30.

The invention claimed is:

1. A facade assembly for a building, comprising:

at least one facade element, configured to be fastened to a wall or an inter-story ceiling of the building, and at least one fire-protection element, configured to be mounted between the facade element and the wall or the inter-story ceiling, wherein the fire-protection element comprises an insulating layer and at least one self-supporting angle profile with two flanges disposed at an angle relative to one another, wherein a first flange of the flanges of the angle profile extends in a first direction and is fastened to the facade element and a second flange of the flanges of the angle profile extends in a second direction corresponding to a direction in which the insulating layer extends, the second flange having a first surface and a second surface opposing the first surface, the first surface and the second surface of the second flange unfastened to the insulating layer, and wherein the first flange and the second flange are made of at least one metal.

2. The facade assembly according to claim 1, wherein the insulating layer is a mineral-wool insulating layer.

3. The facade assembly according to claim 1, wherein both flanges of the angle profile are disposed outside the insulating layer.

4. The facade assembly according to claim 1, wherein the first flange of the angle profile fastened on the facade element is disposed between the insulating layer and the facade element.

5. The facade assembly according to claim 1, wherein the angle profile is an L-shaped profile with equal or unequal legs.

6. The facade assembly according to claim 1, wherein the angle profile is formed at least partly from an intumescent material or is coated with an intumescent material.

7. The facade assembly according to claim 1, further comprising a protective layer which covers the fire-protection element at least partly.

8. A building structure, comprising the facade assembly according to claim 1.

9. The building structure according to claim 8, wherein the second flange of the angle profile bearing on the insulating layer is disposed on a front side of the insulating layer opposite the joint.

10. The building structure according to claim 9, wherein the first flange of the angle profile fastened on the facade element is directed away from the insulating layer.

11. The building structure according to claim 8, wherein the second flange of the angle profile bearing on the insulating layer is disposed on a bottom side of the insulating layer facing the joint.

12. The building structure according to claim 11, wherein the first flange of the angle profile fastened on the facade element is disposed between the insulating layer and the facade element.

13. A method for mounting a facade assembly for a building according to claim 1, said facade assembly comprising at least one facade element, which is fastened to a wall or an inter-story ceiling of the building, and at least one fire-protection element, which is mounted between the facade element and the wall or the inter-story ceiling, wherein the fire-protection element comprises at least one insulating layer and at least one self-supporting angle profile, said method comprising:

attaching the facade element to the wall or the inter-story ceiling of the building, wherein a joint is formed between the facade element and the wall or the inter-story ceiling, attaching the fire-protection element to the facade element and/or to the wall or the inter-story ceiling of the building in the region of the joint, wherein a first flange of the angle profile is fastened to the facade element and extends in a first direction and a second flange of the angle profile extends in a second direction corresponding to a direction in which the at least one insulating layer extend, the second flange having a first surface and a second surface opposing the first surface, the first surface and the second surface of the second flange unfastened to the at least one insulating layer, wherein the first flange and the second flange are made of at least one metal.

14. The method according to claim 13, wherein the insulating layer is introduced into the joint and then the angle profile is applied on the front side of the insulating layer positioned opposite the joint.

15. The method according to claim 13, wherein the angle profile is mounted in the joint, wherein the first flange of the angle profile fastened to the facade element points into the joint, and then the insulating layer is introduced into the joint, wherein the bottom side of the insulating layer opposite the joint is brought into contact with the second flange of the angle profile and the first flange fastened on the facade element is disposed between the insulating layer and the facade element.

16. The facade assembly according to claim 1, wherein the angle profile consists of the at least one metal.

17. The facade assembly according to claim 16, wherein the at least one metal is iron or steel.

18. The facade assembly according to claim 1, wherein the angle profile is fastened to the facade element by a fastener.

19. The facade assembly according to claim 1, wherein the angle profile does not comprise an intumescent material.

20. The facade assembly according to claim 18, wherein the fastener comprises at least one rivet or screw.

* * * * *